United States Patent [19]

Okada

[11] Patent Number: 4,764,943

[45] Date of Patent: Aug. 16, 1988

[54] KNITTING COUNTER

[75] Inventor: Hidekazu Okada, Ashiya, Japan

[73] Assignee: Clover Manufacturing Co., Ltd., Osaka, Japan

[21] Appl. No.: 922,412

[22] Filed: Oct. 23, 1986

[30] Foreign Application Priority Data

Apr. 7, 1986 [JP] Japan ..... 61-52655[U]

[51] Int. Cl.[4] ..... G06M 1/02; G06M 1/08; G06M 1/22

[52] U.S. Cl. ..... 377/6; 377/16; 377/112

[58] Field of Search ..... 377/4, 5, 6, 15, 24, 377/112; 340/323 R; 200/52 R, 86 R; 235/117 A, 144 ME, 93, 114

[56] References Cited

U.S. PATENT DOCUMENTS

| | | | |
|---|---|---|---|
| 3,022,942 | 2/1962 | Van Veen | 235/117 A |
| 3,124,316 | 3/1964 | O'Brien et al. | 377/15 |
| 3,934,123 | 1/1976 | Maurer et al. | 377/15 |
| 4,097,725 | 6/1978 | Lieberman et al. | 377/6 |
| 4,132,905 | 1/1976 | Stein | 377/126 |

FOREIGN PATENT DOCUMENTS 61-384 1/1986 Japan .

*Primary Examiner*—John S. Heyman

*Attorney, Agent, or Firm*—Birch, Stewart, Kolasch & Birch

[57] ABSTRACT

A knitting counter for counting stitches or rows of stitches comprising: a counter casing having a flat bottom surface to be placed in substantially horizontal flat support surface and formed with a reception opening as well as with a window opening; an operating member having a touch portion projecting out through the reception opening as movably guided thereby and a pusher portion extending within the casing; a digital display device disposed at the window opening; and an electrical control circuit arranged within the casing and connected to the display device for controlling thereof; wherein the control circuit incorporates a self-openable count input switch which, when closed each time, functions to change a numerical indication of the display device one by one, the pusher portion is in permanent engagement with the count input switch, and the counter casing has such a shape as to be prevented from toppling down upon a normal push on the touch portion.

8 Claims, 3 Drawing Sheets

KNITTING COUNTER

BACKGROUND OF THE INVENTION

1. Field of the Invention

This invention relates to a knitting counter as an knitter's aid for counting stitches or rows of stitches during a knitting operation, and more particularly to such a counter which is extremely improved in operability.

2. Description of the Prior Art

In knitting a work exactly as scheduled, it is required for a knitter to count stitches or rows of stitches as they are formed. However, such counting and imperative memorization of the counted number are very cumbersome for the knitter. Further, the knitter may erroneously memorize or inadvertently forget the counted number, compelling her to count the knitted stitches or the knitted rows again from the very start. This naturally leads to a drastic reduction in knitting efficiency.

In order to avoid the above problem, Japanese Utility Model Publication No. 61-384 discloses a knitting counter which comprises a rectangular parallelepiped counter casing and a movable operating member. More specifically, the counter casing has a top wall formed with a slot opening and a front wall formed with a pair of window openings. The operating member, which is in the form of a plate, is slidably inserted through the slot opening into the casing and has an enlarged push head positioned outside the casing. First and second discal dial plates are rotatably supported on the casing front wall in corresponding relation to the window openings. Each of the dial plates carries a circumferential row of numerals including zero (0) to nine (9), so that the numerals are displayed successively at a corresponding one of the window openings as the dial plate makes one full turn. Each of the dial plates is also provided with an integral ratchet wheel having ten teeth. The first dial plate is further provided with a presser projection. The operating member, on the other hand, has a first ratchet pawl which successively engages with the teeth of the ratchet wheel of the first dial plate to index the first dial plate every time the operating member is pressed downward. The operating member further has a second ratchet pawl which is deformed by the presser projection of the first dial plate into successive engagement with the teeth of the ratchet wheel of the second dial plate to index the second dial plate when the operating member is pressed downward every ten times.

The thusly arranged counter has a shape resembling a handy cigarette lighter, so that it is supported very poorly on a table or like flat surface. In other words, the counter may easily topple down on the table even upon a normal push on the operating member. Thus, in use, a knitter must manually take up the counter from the table to press the operating member every time a stitch or a row of stitches are formed. This unacceptably interrupts the knitting operation.

Further, with the counter of the above Publication, a considerable push stroke (at least corresponding to a rotational angle of 36 degrees) is required to properly index the dial plates, so that a counting error will often result due to an insufficient push. Moreover, the mechanical construction of the counter is very complicated and liable to failures and troubles.

SUMMARY OF THE INVENTION

It is, therefore, an object of the present invention to provide a knitting counter which is usable without manually picking up and without requiring a large push stroke, thereby providing a drastically improved operability.

Another object of the invention is to provide a knitting counter which is selectively operable for counting up or down stitches or rows of stitches depending on a particular requirement involved.

A further object of the invention is to provide a knitting counter which can be reset to an initial condition by a simple operation.

Other objects, features and advantages of the invention will become apparent from the following detailed description.

According to the present invention, there is provided a knitting counter for counting stitches or rows of stitches comprising: a counter casing having a flat bottom surface to be placed on a substantially horizontal flat support surface and formed with a reception opening as well as with a window opening; an operating member having a touch portion projecting out through the reception opening as movably guided thereby and a pusher portion extending within the casing; a digital display device disposed at the window opening; an electrical control circuit arranged within the casing and connected to the display device for controlling thereof; the control circuit incorporating a self-openable count input switch which, when closed each time, functions to change a numerical indication of the display device one by one; the pusher portion being in permanent engagement with the count input switch; and the counter casing has such a shape as to be prevented from toppling down upon a normal push on the touch portion.

DETAILED DESCRIPTION

Figure 1:
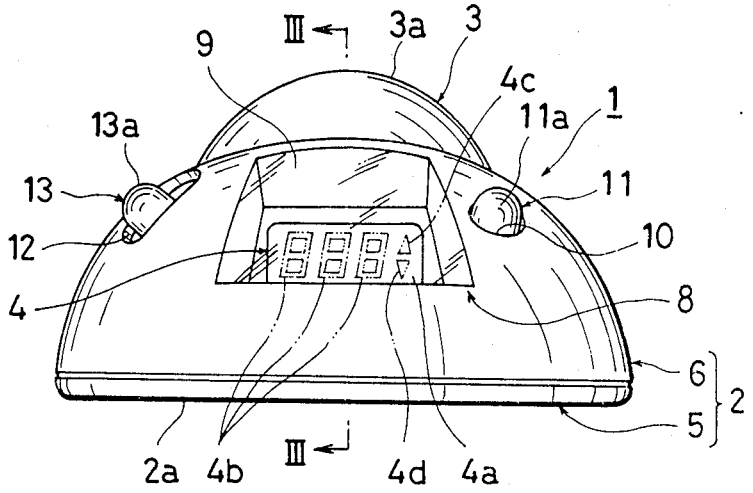
FIG. 1 is a front elevation of a knitting counter embodying the invention.

Referring now to the accompanying drawings, a knitting aid or counter generally represented by reference numeral 1 mainly comprises a counter casing 2 to be placed on a flat horizontal surface (not shown) such as a table surface, an operating member 3 movably supported by the casing 2, and a display device 4 for indicating required information on its display surface 4*a*.

Figure 3:
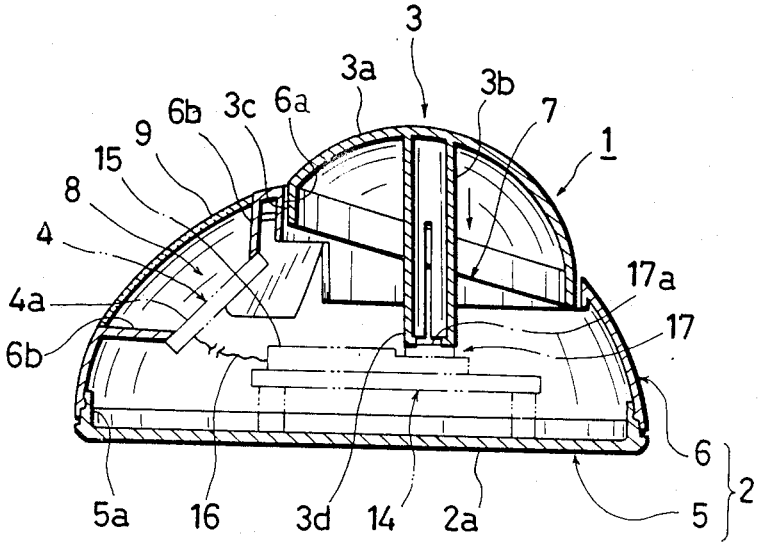
FIG. 3 is a section taken on lines III—III in FIG. 1.

The counter casing 2 comprises a discal bottom plate 5 which is integrally formed with an upwardly directed annular mounting projection 5*a* (see FIG. 3) and which provides a flat bottom surface 2*a* of the casing 2 to ensure stable support on a table for example. The casing 2 further comprises a hollow hemispherical body 6 removably mounted at its open bottom to the mounting projection 5*a* of the discal plate 5.

The hemispherical body 6 of the casing 2 has a top rear reception opening 7 defined by a vertically extending, inturned annular guide wall 6*a* of the body 6 for receiving the operating member 3. The body 6 also has a front window opening 8 defined by inturned frame walls 6b of the body 6. The display device 4 is disposed immediately behind the window opening 8 as attached to the window frame walls 6b. The window opening 8 is closed by a transparent window glass 9, so that a knitter can see any indication on the display surface 4a of the display device 4 through the window glass 9.

Figure 2:
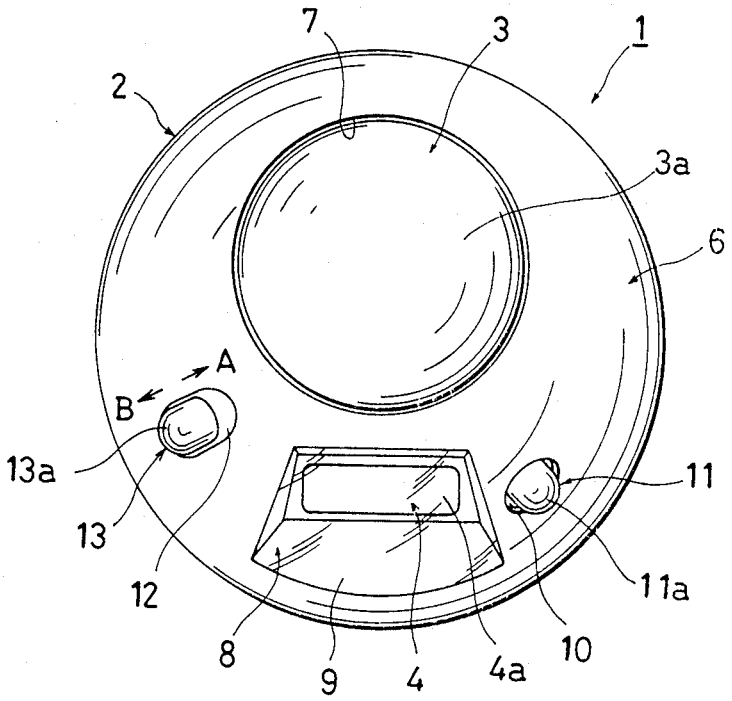
FIG. 2 is a top plan view of the same.

As illustrated in FIGS. 1 and 2, the hemispherical body 6 is further formed with a first side opening 10 through which projects out a reset switch 11 having a hemispherical head 11a, whereas the body 6 is formed on the other side of the window opening 8 with a second side opening 12 through which extends out a count mode selector switch 13 similarly having a hemispherical head 13a. The function of the switches 11, 13 will be described hereinafter.

According to the illustrated example, the display device 4 is provided in the form of an LCD (liquid crystal display) which is capable of representing, on the display surface 4a, a numerical indication 4b in three digits to notify the knitter as to the number of stitches or rows of stitches. The LCD 4 is also capable of representing either of an upward arrow 4c and a downward arrow 4d to teach the knitter whether the knitting counter 1 is in a up-count mode or a down-count mode.

Within the counter casing 2 is disposed a printed circuit board 14 on which is arranged an LSI 15 for electrically controlling the LCD 4 via a lead 16 in response to the operation of a push-on type count input switch 17 connected to the LSI 15 and having an engaging head 17a. The switch 17 is always biased elastically to its open position.

The operating member 3 comprises a slanting, domed touch portion 3a which projects from the top rear opening 7 of the counter casing 2, and a cylindrical pusher portion 3b which extends vertically downward into the casing. The touch portion 3a has a vertically extending lower edge 3c which is slidably fitted in the annular guide wall 6a of the casing 2, so that the operating member 3 is movable up and down as guided by the annular guide wall 6a. The pusher portion 3b, on the other hand, has an open lower end 3d fitting around the engaging head 17a of the count input switch 17. Thus, the count input switch 17 is closed every time the touch portion 3a of the operating member 3 is touched or pressed by the knitter. The switch 17 automatically becomes open immediately after the operating member 3 is liberated because the switch 17 is self-urged to its open position as previously described.

Figure 4:
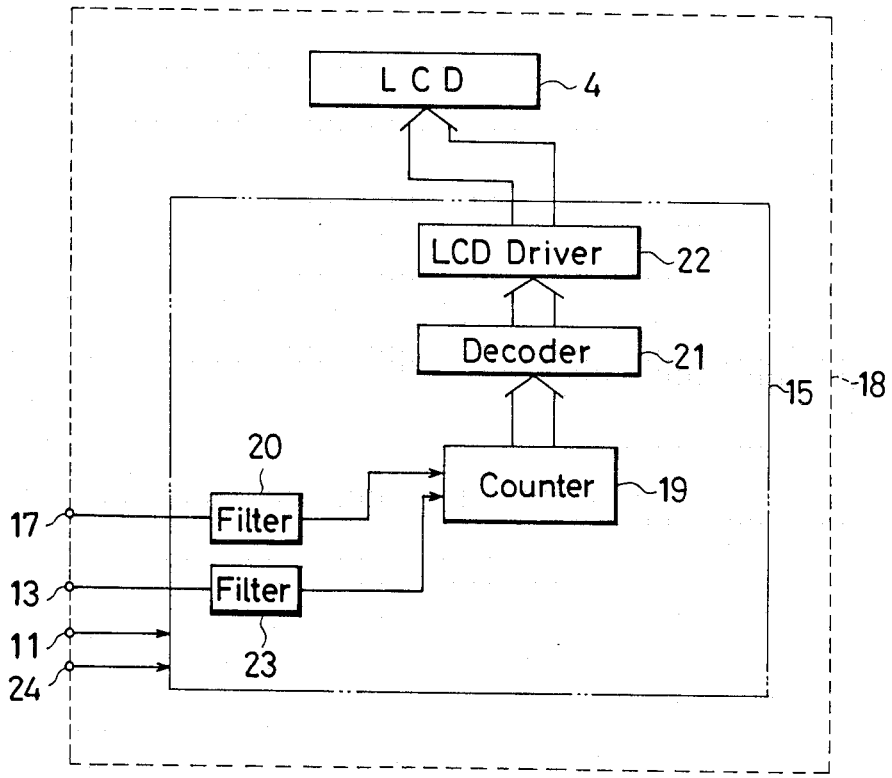
FIG. 4 is block diagram illustrating a control circuit incorporated into the knitting counter of FIG. 1.

As illustrated in FIG. 4, the LCD 4 is incorporated into an overall circuit 18 which also incorporates the LSI or display control circuit 15 driven by a battery type power source (not shown) mounted on the casing bottom plate 5.

The LSI 15 comprises a counter circuit 19 which counts up or down the number of input signals (clock pulses) received through the count input switch 17 and a noise filter 20. The content of the counter circuit 19 is read by a decoder circuit 21 to give output to an LCD driver circuit 22 which in turn drives the LCD 4 to provide the required numerical indication 4b on the display surface 4a.

The count mode selector switch 13 (see also FIGS. 1 and 2) is connected to the counter circuit 19 through a noise filter 23. By moving the selector switch 13 in the directions of arrows A and B, the counter circuit 19 is shifted between the up-count mode and the down-count mode. The selected count mode of the counter circuit 19 or the knitting aid 1 (FIGS. 1 to 3) is indicated by one of the arrows 4c, 4d appearing on the display surface, as described hereinbefore.

The numerical indication 4b appearing on the display surface 4a of the LCD 4 can be rendered to zero by operating the reset switch 11 connected to the LSI 15.

According to the illustrated example, the tenth and hundredth digits of the numerical indication 4b are subjected to zero suppression.

If desired, the LSI 15 may include additional circuits to provide various functions. For example, the LSI 15 may include a settable drive circuit (not shown) which is connected to a sounding device (not shown) and which is set for example to cause the sounding device to produce a sound upon every touch or every ten touches on the operating member 3, whereby the progress of the counter can be audibly recognized to ensure a reliable counting operation. Such sound setting may be cancelled by operating an all-clear switch 24 connected to the LSI 15. Further, the LSI 15 may also include a clock circuit (not shown) which cause the LCD 4 to work as a clock when out of a counting operation.

In operation, with the numerical indication 4b on the display surface 4a representing zero for example, the mode selector switch 13 is first operated so that the counter circuit 19 or the knitting aid 1 is brought into the up-count mode and the upward arrow 4c appears on the display surface 4a. The domed touch portion 3a of the operating member 3 is then pressed manually every time a stitch or a row of stitches are formed, consequently closing the count input switch 17 which thereafter returns spontaneously to its original open position. As a result, the numerical indication 4b on the display surface 4a increases one by one up to 999 at the maximum on the basis of the function of the counter circuit 19, the decoder circuit 21 and the LCD driver circuit 22.

When an error is found during knitting, it is often required to drop or cancel some stitches or rows of stitches. In such an event, the knitting counter 1 is put into the down-count mode by operating the mode selector switch 13, so that each push or touch on the domed touch portion 3a causes the numerical indication 4b on the display surface 4a to decrease one by one.

When needed, the numerical indication 4b on the display surface 4a may be reduced down to zero by a push on the reset switch 11.

Because of the hemispherical shape of the counter casing 2 with the flat bottom surface 2a, the knitting counter 1 is supported on a horizontal flat surface very stably, so that a push on the domed touch portion 3a of the operating member 3, even if vigorously made, will not cause the counter 1 to topple down. The domed shape of the touch portion 3a, on the other hand, enables that a push force applied to the touch portion at any location thereof produces a downward force component and thereby causes the operating member 3 guided by the annular guide wall 6a to move downward to close the count input switch 17.

Because the cylindrical pusher portion 3b of the operating member 3 extends enough to engage at the open lower end 3d thereof with the engaging head 17a of the count input switch 17, even a slight push on the domed touch portion 3a will allow the switch 17 to close, thus preventing any failure in counting stitches or rows of stitches.

The invention being thus described, it will be obvious that the same may be varied in many ways. For instance, the counter casing 2 may have a shape of cone frustum, pyramid frustum, or cube or any other shape, provided that such selected shape will enable the knitting counter 1 to stand stably on a horizontal flat surface even at the time of pushing the operating member 3. Further, the knitting counter 1 may be modified so that when the operating member 3 is held pressed, the numerical indication **4*b* on the display surface 4*a*** continues to increase to a desired value. Such variations are not to be regarded as departure from the spirit and scope of the invention, and all such modifications as would be obvious to those skilled in the art are intended to be included within the scope of the appended claims.

I claim:

1. A knitting counter for counting stitches or rows of stitches incremented or decremented solely through human stroking, comprising:

a counter casing having a flat bottom surface to be placed on a substantially horizontal flat support surface and formed with a window opening as well as with a reception opening at the top of said casing and defined by a downwardly extending inturned annular guide wall;

a movable operating member for human stroking including a domed touch portion projecting out through said reception opening, a downwardly extending lower edge slidably fitted in said annular guide wall, and a pusher portion extending downwardly within said casing;

a digital display device disposed at said window opening;

an electrical control circuit including a counter arranged within said casing and connected to said display device for controlling thereof;

said control circuit incorporating a normally biased-open input switch connected to said counter which, when closed each time, functions to increment said counter and change a numerical indication of said display device one by one;

said pusher portion having a lower end in permanent engagement with said normally open input switch so as to close said input switch even in response to a slight human stroke on said touch portion; and said counter casing shaped to be stable and prevented from toppling even upon vigorous stroking of said touch portion and without a need to look.

2. The knitting counter as defined in claim 1, wherein said counter casing comprises a discal bottom plate integrally formed with an upwardly directed annular mounting projection, and a hollow hemispherical body removably mounted at an open bottom thereof to said mounting projection.

3. The knitting counter as defined in claim 2, wherein said pusher portion which is cylindrical extends vertically downward and has an open lower end, and said normally biased-open input switch has an engaging head fitted into said open lower end of said pusher portion.

4. The knitting counter as defined in claim 2, wherein said window opening is located at a front portion of said hemispherical body and defined by inturned frame walls, and said display device is disposed immediately behind said said window opening as attached to said frame walls.

5. The knitting counter as defined in claim 1, wherein said control circuit is connected to a reset switch which extends out through said counter casing and which, when operated, changes the numerical indication of said display device to zero.

6. The knitting counter as defined in claim 1, wherein said control circuit is connected to a mode selector switch which extends out through said counter casing and which, when operated, shifts said counter from an up-count mode to a down-count mode or vice versa.

7. The knitting counter as defined in claim 6, wherein said display device is also adapted to provide an arrow indication to notify whether said counter is in the up-count mode or the down-count mode.

8. The knitting counter as defined in claim 2, wherein said guide wall extends vertically at a top rear portion of said hemispherical body, and said domed touch portion is slanted with said lower edge extending vertically.

* * * * *